US006935709B2

(12) United States Patent
Powell et al.

(10) Patent No.: US 6,935,709 B2
(45) Date of Patent: Aug. 30, 2005

(54) HOUSING CONSTRUCTION FOR RACK-MOUNTED ELECTRONIC EQUIPMENT

(75) Inventors: Mark H. Powell, Marina del Rey, CA (US); Etienne H. Iliffe-Moon, Los Angeles, CA (US); David Wathen, Los Angeles, CA (US)

(73) Assignee: Gibson Guitar Corp., Nashville, TN (US)

( * ) Notice: Subject to any disclaimer, the term of this patent is extended or adjusted under 35 U.S.C. 154(b) by 68 days.

(21) Appl. No.: 10/404,022

(22) Filed: Mar. 31, 2003

(65) Prior Publication Data

US 2003/0210530 A1 Nov. 13, 2003

Related U.S. Application Data

(60) Provisional application No. 60/369,909, filed on Apr. 4, 2002.

(51) Int. Cl.[7] ..... A47B 81/00
(52) U.S. Cl. ..... 312/223.2; 312/223.1
(58) Field of Search ..... 312/223.2, 223.1, 312/257.1, 263, 265.5; 361/724, 725, 727; 211/26; 220/4.24

(56) References Cited

U.S. PATENT DOCUMENTS

| | | | | | |
|---|---|---|---|---|---|
| 3,228,532 | A | | 1/1966 | Sisk et al. | 211/26 |
| 4,120,545 | A | | 10/1978 | Happak et al. | 312/7 |
| 4,710,136 | A | | 12/1987 | Suzuki | 439/374 |
| 5,808,867 | A | * | 9/1998 | Wang | 361/695 |
| 5,971,507 | A | * | 10/1999 | Peroni | 312/223.2 |
| 5,988,410 | A | * | 11/1999 | Mandle | 211/133.1 |
| 5,992,953 | A | * | 11/1999 | Rabinovitz | 312/111 |
| 6,061,244 | A | | 5/2000 | O'Sullivan et al. | 361/727 |
| 6,141,221 | A | | 10/2000 | Tong et al. | 361/724 |
| 6,203,130 | B1 | * | 3/2001 | Montgelas et al. | 312/223.2 |
| 6,222,727 | B1 | | 4/2001 | Wu | 361/685 |
| 6,301,103 | B1 | | 10/2001 | Abboud | 361/683 |
| 6,360,900 | B1 | | 3/2002 | Carbonneau et al. | 211/26 |
| 6,370,022 | B1 | * | 4/2002 | Hooper et al. | 361/685 |
| 6,496,362 | B2 | * | 12/2002 | Osterhout et al. | 361/685 |
| 6,498,727 | B2 | * | 12/2002 | Carr | 361/725 |
| 6,590,151 | B1 | * | 7/2003 | Merk et al. | 174/35 R |

* cited by examiner

*Primary Examiner*—Janet M. Wilkens
(74) *Attorney, Agent, or Firm*—Waddey & Patterson, P.C.; Lucian Wayne Beavers

(57) ABSTRACT

A housing for an electronic apparatus capable of being mounted in a rack by a rack ear is presented, the housing including an upper housing portion having a top and left and right sides, wherein each of the sides of the upper housing portion has an upper groove portion defined therein, the upper groove portion formed by a indentation formed in each of the sides; a lower housing portion having a bottom and left and right sides, wherein each of the sides of the lower housing portion has a lower groove portion defined therein, the lower groove portion formed by a indentation formed in each of the sides, wherein the upper housing portion and the lower housing portion cooperate to form the housing, and further wherein, when the upper housing portion and the lower housing portion are combined to form the housing, the upper groove portion and the lower groove portion combine to form a track groove shaped to receive a rack mounting ear are formed on the left and right sides of the housing.

22 Claims, 6 Drawing Sheets

HOUSING CONSTRUCTION FOR RACK-MOUNTED ELECTRONIC EQUIPMENT

RELATED APPLICATION

This application claims benefit under 35 U.S.C. §119(e) of U.S. Provisional Patent Application Ser. No. 60/369,909 filed Apr. 4, 2002, entitled "Clamshell Housing with Sliding Rack Ears," the details and disclosure of which are hereby incorporated by reference.

BACKGROUND OF THE INVENTION

1. Field of the Invention

The present invention relates generally to housing constructions for rack mounted electronic equipment. More particularly, the present invention relates to audio equipment featuring a unique and convenient method of mounting within an audio rack.

2. Description of the Prior Art

Conventional construction of housings for rack mounted electronic equipment, such as audio equipment like audio amplifiers, generally comprises a rectangular sheet metal box formed from portions of bent sheet metal. Typically, these housings have "rack ears" permanently mounted thereon. The rack ears can be adjustable with respect to the housing itself, and engage mounting positions in a rack, which thereby allows them to be mounted at various locations in the rack. Typical of such constructions is that disclosed by Carbonneau and Kibler in U.S. Pat. No. 6,360,900 in which an adjustable rack mounting system for a data storage chassis is described.

Other mounting systems, which have been suggested in the art, including that of O'Sullivan and Farrell in U.S. Pat. No. 6,061,244 in which a disk drive case for a computer having a pivoting hook is described. In U.S. Pat. No. 4,120,545, Happak and Whittman disclose a housing having lateral depressions to accommodate guide elements for sliding the housing into a rack. Other similar mounting structures are shown by Sisk, Shapiro, Vesciglio, and Watkin in U.S. Pat. No. 3,228,532 and Suzuki in U.S. Pat. No. 4,710,136. Although each of these patents describe differing apparatus for mounting electronic equipment in a rack or related structure, none provide the flexibility and adaptability sought after in the art.

What is desired, therefore, is a rack mounting system for electronic equipment, especially audio equipment, which provides increased flexibility in mounting the equipment in a rack. In addition, because of the thermal demands of professional audio equipment, a rack mounting system which permits greater thermal dissipation from the equipment is also highly desired.

SUMMARY OF THE INVENTION

The present invention provides a housing for rack mounted electronic equipment, especially audio equipment, such as audio amplifiers and the like. The inventive housing comprises upper and lower housing portions which cooperate to form the equipment housing within which electronic components, such as those of an audio amplifier, are housed. Each of the upper and lower housing portions comprise upper and lower track groove portions defined therein such that when the upper and lower housing portions are mated to form the housing, track grooves shaped to receive a "rack ear" or bracket are formed therein on either side of the housing. In use, the track grooves are engaged by the rack ears which thereby mount the electronic equipment into the rack. Thus, adjustability of the rack ears provides ready adjustability for mounting of the electronic equipment.

Accordingly, it is an object of the present invention to provide an improved housing construction for rack mounted electronic equipment.

Another object of the invention is the provision of improved housing construction for an audio amplifier.

Still another object of the present invention is a housing construction for electronic equipment which permits ready adjustability of the mounting of the electronic equipment in a rack.

Another object of the invention is to provide a housing construction for an audio amplifier which provides superior thermal dissipation characteristics.

Still another object of the invention is to provide an infinitely variable adjustment to suit a wide variety of known and unknown rack depths over the given range of the rack ear.

These objects and other which will be apparent to the skilled artisan upon reading the following description can be achieved by providing a housing for an electronic apparatus capable of being mounted in a rack by a rack ear, the housing including an upper housing portion having a top and also having left and right sides, each of the left and right sides of the upper housing portion having a front portion and a rear portion, wherein each of the sides of the upper housing portion has an upper groove portion defined therein, the upper groove portion formed by a indentation formed in each of the sides of the upper housing portion; a lower housing portion having a bottom and also having left and right sides, each of the sides of the lower housing portion having a front and a rear, wherein each of the sides of the lower housing portion having a lower groove portion defined therein, the lower groove portion formed by a indentation formed in each of the sides of the lower housing portion, wherein the upper housing portion and the lower housing portion cooperate to form the housing having left and right sides, and further wherein, when the upper housing portion and the lower housing portion are combined to form the housing, the upper groove portion and the lower groove portion combine to form a track groove shaped to receive a rack mounting ear on the left and right sides of the housing.

In the inventive housing, the upper groove portion has a wider portion disposed near the rear of the upper housing portion and extending closer to the top of the upper housing portion and a narrower portion disposed closer to the front of the upper housing portion than the wider portion and not extending as close to the top of the upper housing portion as the wider portion. Similarly, the lower groove portion has a wider portion disposed near the rear of the sides of the lower housing portion extending closer to the bottom of the lower housing portion and a narrower portion disposed closer to the front of the lower housing portion than the wider portion and not extending as close to the bottom of the lower housing portion as the wider portion. Thus, the track groove formed from the combination of the upper groove portion and the lower groove portion has a front-most narrow portion and a rear-most wide portion.

In a preferred embodiment, at least one of the upper track groove portions and lower track groove portions includes a slot formed by forming a lip about at least a portion of the periphery of at least one of the upper track groove portions and lower track groove portions. Most preferably the lip formed about at least a portion of the periphery of at least one of the upper track groove portions and lower track groove portions is integral with the unindented body of the side of the housing on which it is located.

Associated with the inventive housing is a rack ear shaped so as to be capable of being received in each of the track grooves. Moreover, the rack ear comprises an ear portion capable of being mounted to a rack for electronic apparatus. Preferably, the rack ear has a front-most narrow portion and a rear-most wide portion and is shaped so as to be capable of being received in each of the track grooves. When the track grooves have slots formed therein, the rack ear preferably has a lip portion formed in at least a portion of its periphery, the lip portion sized to be received in the slot formed in at least one of the track grooves.

Advantageously, the inventive housing also has a front panel having extensions therefrom which have mounting holes for mounting to the front portion of a rack for electronic apparatus.

It is to be understood that both the foregoing general description and the following detailed description present embodiments of the invention and are intended to provide an overview or framework of understanding the nature and character of the invention as it is claimed. The accompanying drawings are included to provide a further understanding of the invention and are incorporated in and constitute a part of this specification. The drawings illustrate various embodiments of the invention and together with the description serve to explain the principles and operations of the invention.

DESCRIPTION OF THE PREFERRED EMBODIMENTS

Figure 1:
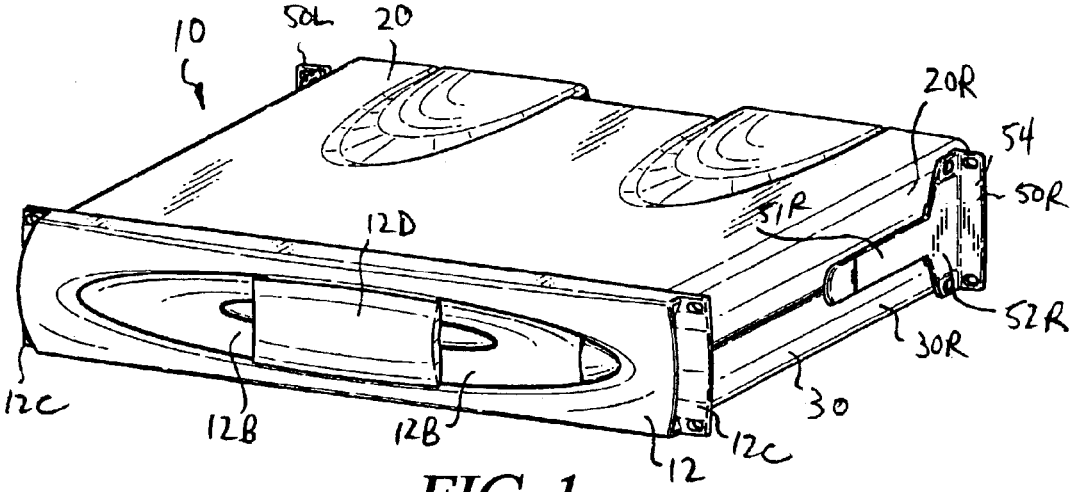
FIG. 1 is a front perspective view of a housing construction in accordance with the present invention.

Embodiments of the present invention will now be described in greater detail with respect to the aforementioned drawings. Like or similar reference numerals will be used to denote like elements whenever possible. The housing construction will be described in terms of professional audio equipment for mounting in a rack; such as for convenience only. It will be understood that the inventive housing construction can be applied to any suitable electronic components for rack mounting. Likewise, the invention will be described with respect to a specific orientation and relationship of elements with respect to each other, but it will be recognized by the skilled artisan that other orientations and relationships will be equally applicable.

Referring now to the drawings, and particularly to FIG. 1, a housing for an electronic apparatus is shown and generally designated by the numeral 10. Housing 10 comprises an upper housing portion 20, a lower housing portion 30 and front housing panel 12 and rear housing panel 14. Each of upper and lower housing portions 20 and 30 and front and rear panels 12 and 14 can be formed of metal such as die cast aluminum or, alternatively, they can be molded out of plastic, polycarbonate or other resin materials or formed of cast zinc or other metals.

Figure 4:
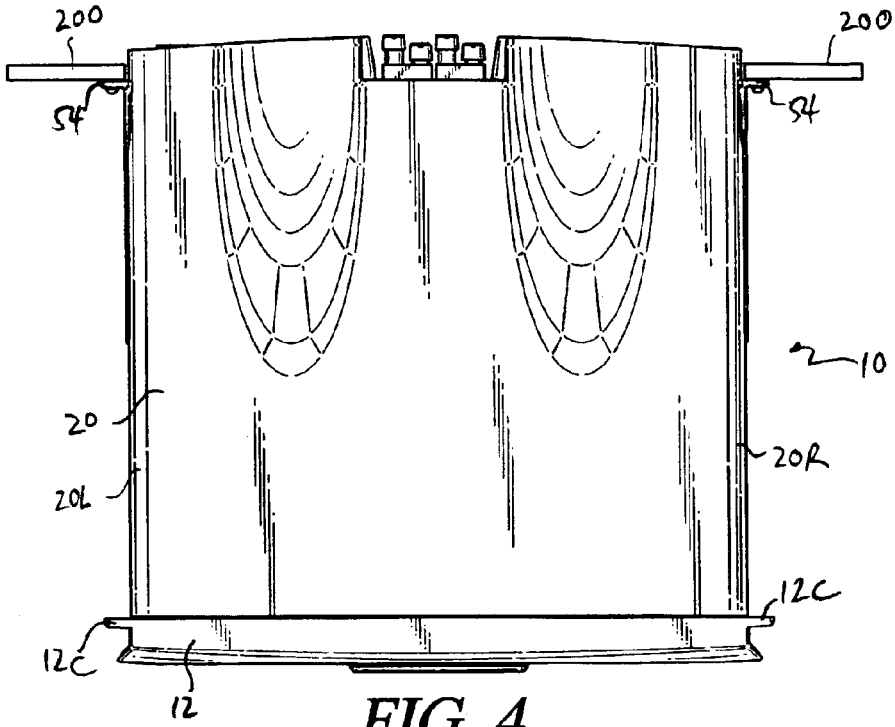
FIG. 4 is a top plan view of the housing construction of FIG. 1, mounted in a rack.

Upper housing portion 20 and lower housing portion 30 each comprise left side portions (denoted 20L and 30L) and right side portions (denoted 20R and 30R), where these side portions mate to form housing 10. In other words, in forming housing 10, upper housing portion 20 and lower housing portion 30 are fitted together such that left side portion 20L of upper housing portion 20 meets and mates with left side portion 30L of lower housing portion 30; likewise, right side portion 20R of upper housing portion 20 meets and mates with right side portion 30R of lower housing portion 30. It will be noted that the designations "left" and "right" are for the sake of convenience only, and refer to housing 10 in the orientation illustrated in FIG. 4.

Likewise, although upper and lower housing portions 20 and 30 and front and rear housing panels 12 and 14 can comprise individual elements to be combined to form housing 10, either upper housing portion 20 or lower housing portion 30 can be formed with front panel 12 and rear panel 20 integral therewith. Or upper and lower housing portions 20 and 30 can be formed with one of front and rear housing panels 12 and 14 and vice versa.

In use, one or both of upper and lower housing portions 20 and 30 comprise the electronic components (generally denoted herein at 100) which, taken together, form the electronics contained in housing 10. For instance, electronics 100 can be those electronics necessary for audio amplification, when housing 10 is used for an audio amplifier. Other electronic components can also be housing within housing 10, depending on the desired end use. Typically, rear housing panel 14 contains plugs 14A in operative communication with electronic components 100 for power and audio contact with components 100. Cooling vents 14B can also be found in rear housing panel 14. Also typically, front housing panel 12 can have control knobs 12A for electronic components 100, as well as cooling vents 12B.

Figure 6:
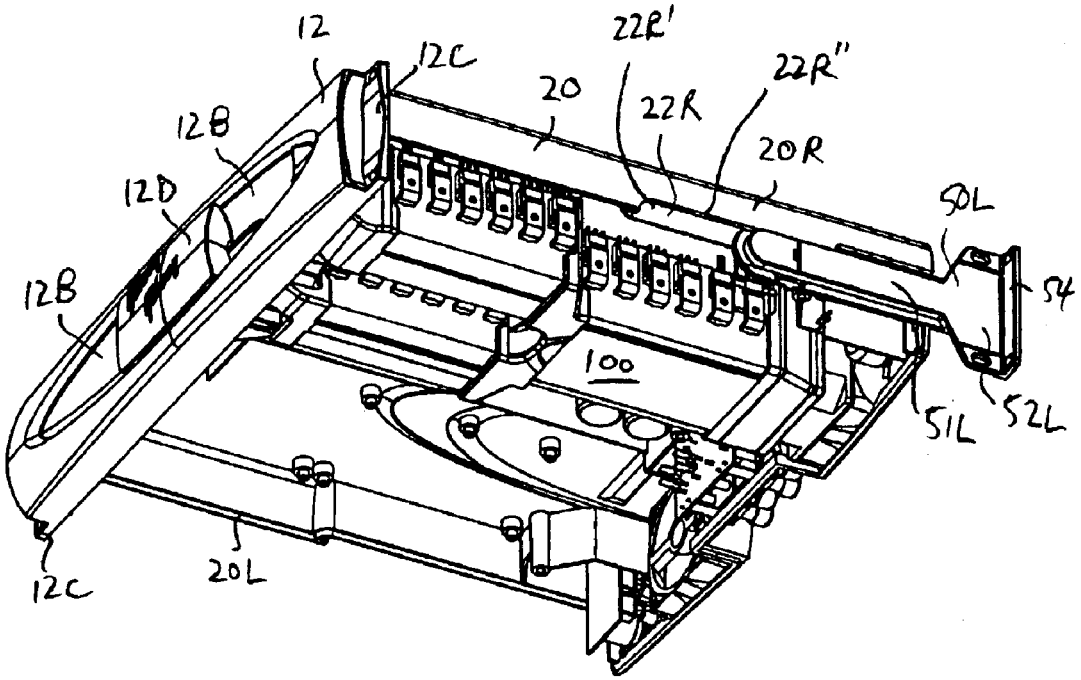
FIG. 6 is a front perspective view of the upper housing portion of the housing construction of FIG. 1, with a rack ear partially inserted in the track groove portion thereof.
Figure 7:
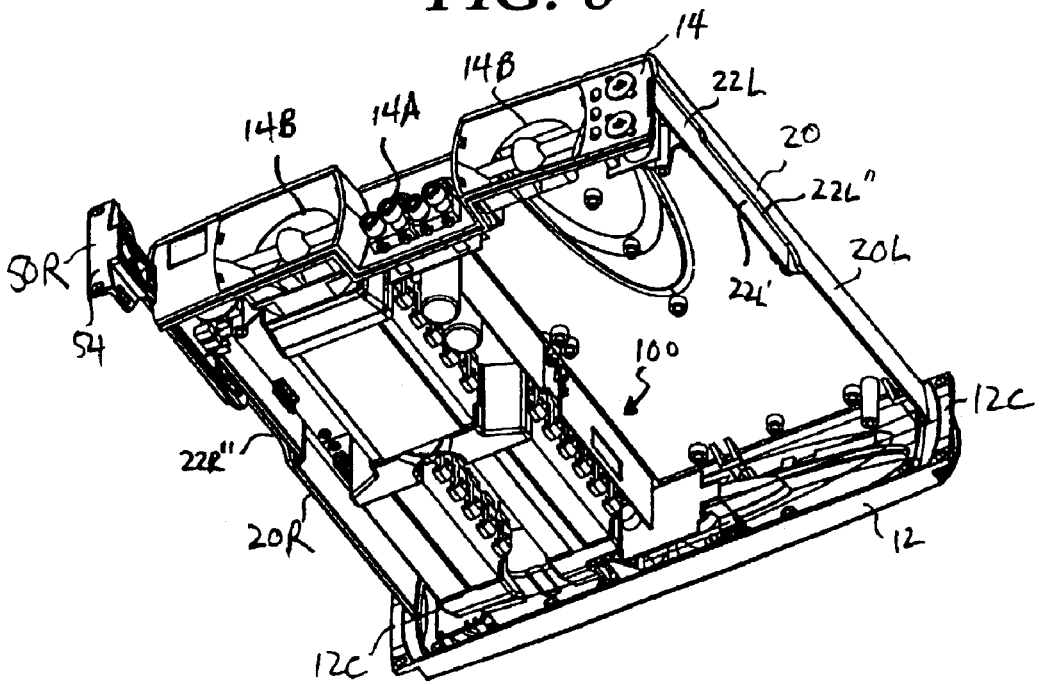
FIG. 7 is a rear perspective view of the upper housing portion of the housing construction of FIG. 1, with a rack ear partially inserted in the track groove portion thereof.
Figure 8:
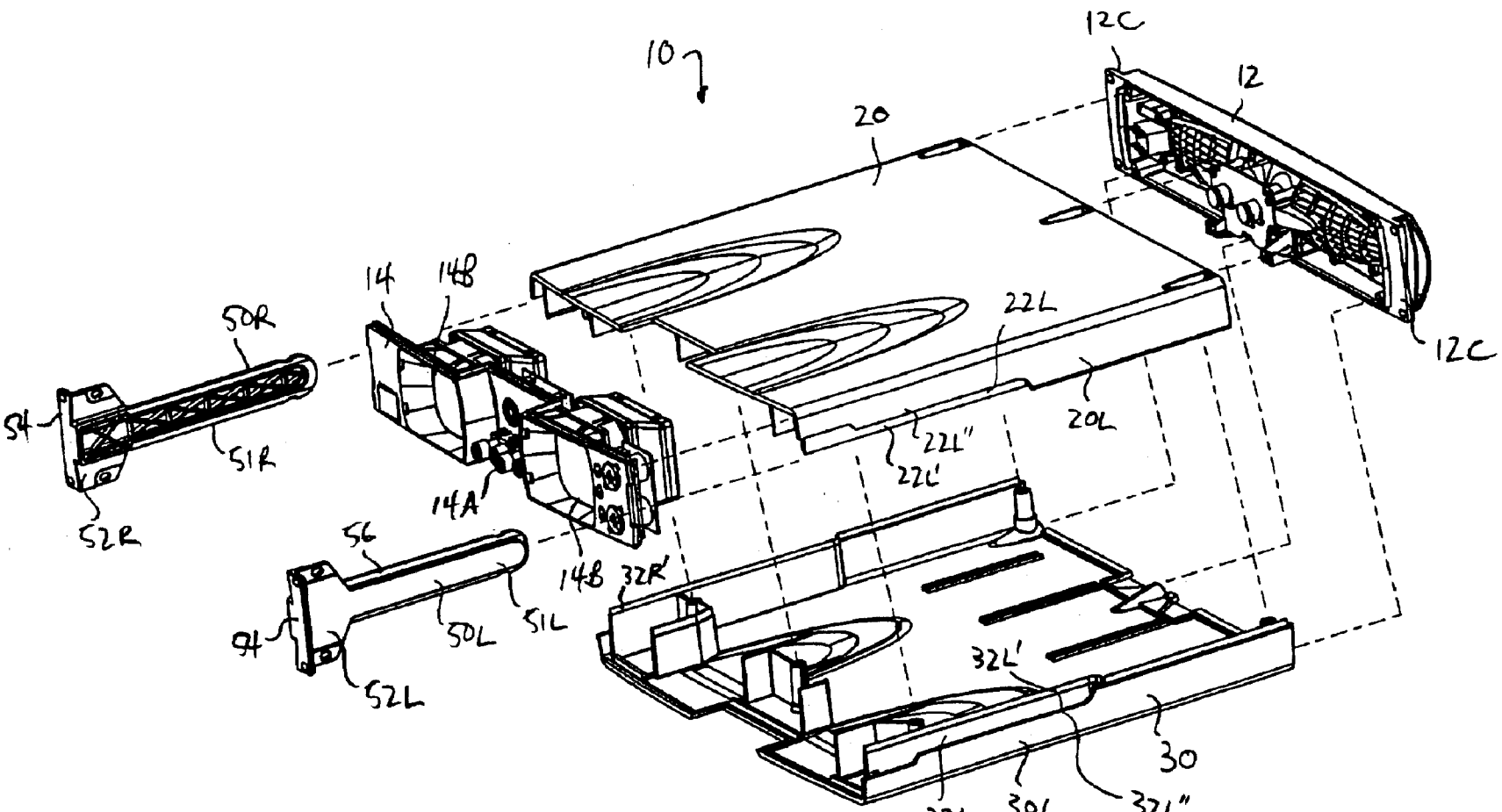
FIGS. 8 and 9 are exploded views of a housing construction in accordance with the present invention.
Figure 9:
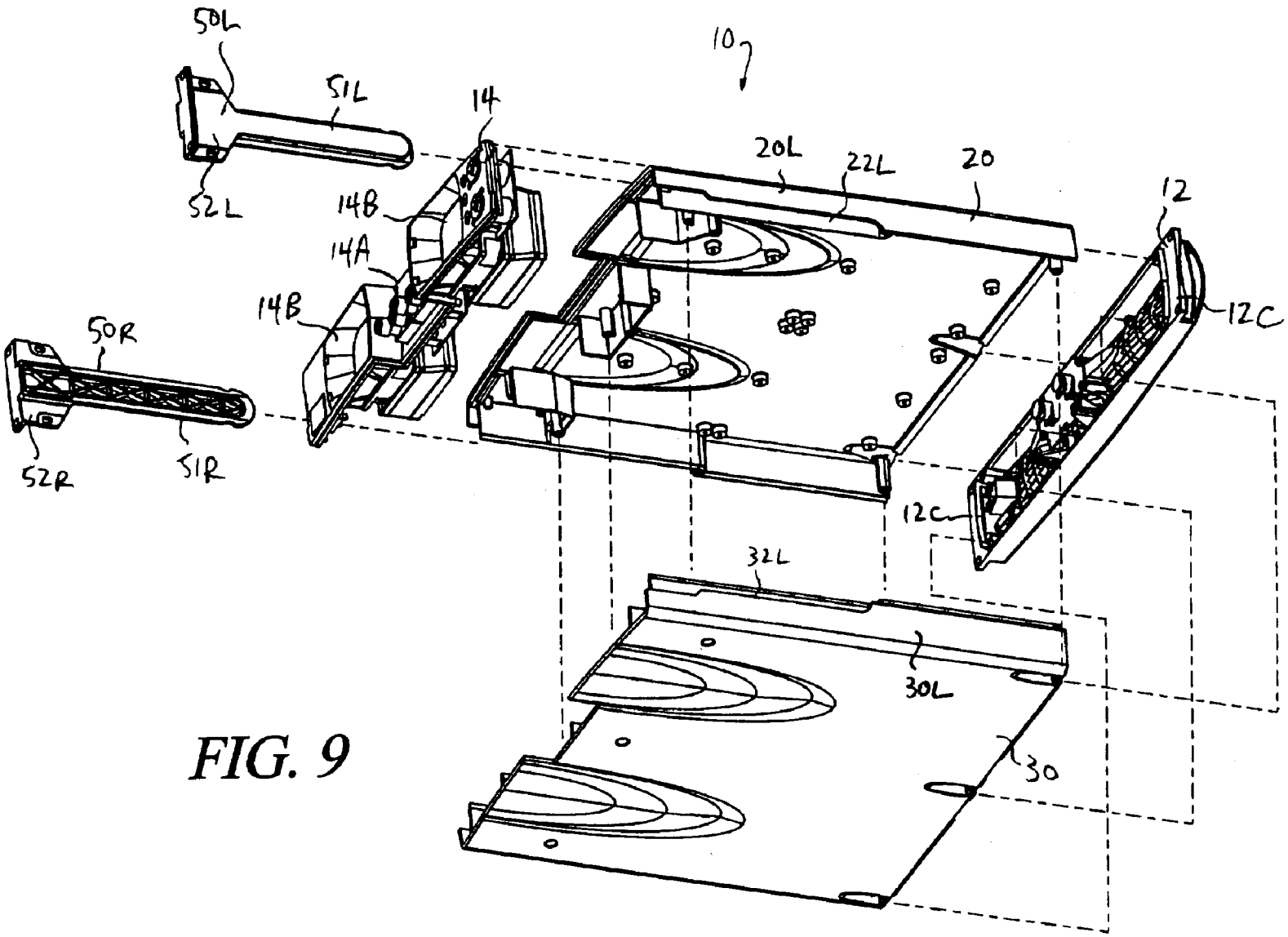

As best seen in FIGS. 6–8, upper housing portion 20 comprises upper track groove portions 22 formed therein. More specifically, an upper track groove portion 22L is formed on left side 20L of upper housing portion 20, and another upper track groove portion 22R is formed on right side 20R of upper housing portion 20. Track groove portions 22L and 22R can be formed in upper housing portion 20 by machining, molding, or more preferable, by casting as part of the casting operation which formed upper housing portion 20.

Similarly, lower housing portion 30 has a right side lower track groove portion 32L formed therein on left side 30L thereof and a left side lower track groove portion 32R formed therein on the right side 30R thereof in a similar manner as described in upper housing portion 20.

When upper and lower housing portions 20 and 30 are joined together to form housing 10, upper right side track groove portion 22L combines with lower right side track groove 32L to form a left side track groove 40L. In the same manner, left side upper track groove portion 22R and left side lower track groove portion 32R combine to form a right side track groove 40R, formed in a left and right sides of housing 10 as best illustrated in FIGS. 10 and 11.

Housing 10 can be formed from upper housing portion 20 and lower housing portion 30 by conventional means. For instance, they can be bolted or screwed together or in the alternative, a lip can be formed on one of upper and lower housing portions 20 and 30, such as lower housing portion 30 to be engaged by a slot formed in upper housing portion 20, or combinations thereof. Front and rear panels 12 and 14 can then be attached (such as by screws, bolts, or other like attachment elements) to the combined upper housing portion 20 and lower housing portion 30.

Right and left track grooves 40R and 40L are sized and shaped so as to receive a sliding rack ear on either side thereof. More specifically, track groove 40L can receive a left side sliding rack ear 50L and track groove 40R can receive a right side sliding rack ear 50R, each of right and left side sliding rack ears 50R and 50L being mounted in a rack 200 in which housing 10, and electronic equipment disposed within housing 10 is sought to be mounted.

Figure 10:
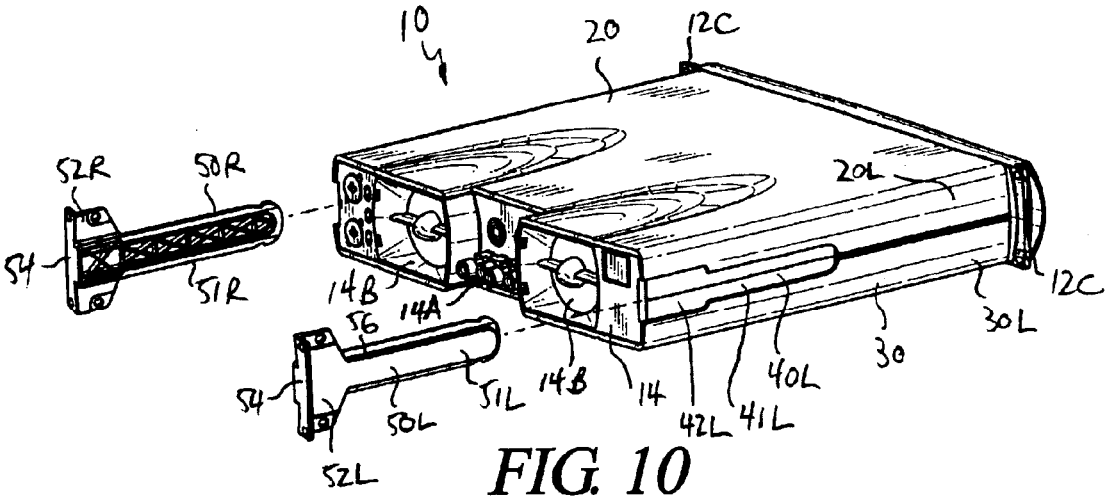
FIG. 10 is a rear perspective view of the housing construction of FIG. 1, with rack ears shown about to be inserted in the track grooves thereof.
Figure 11:
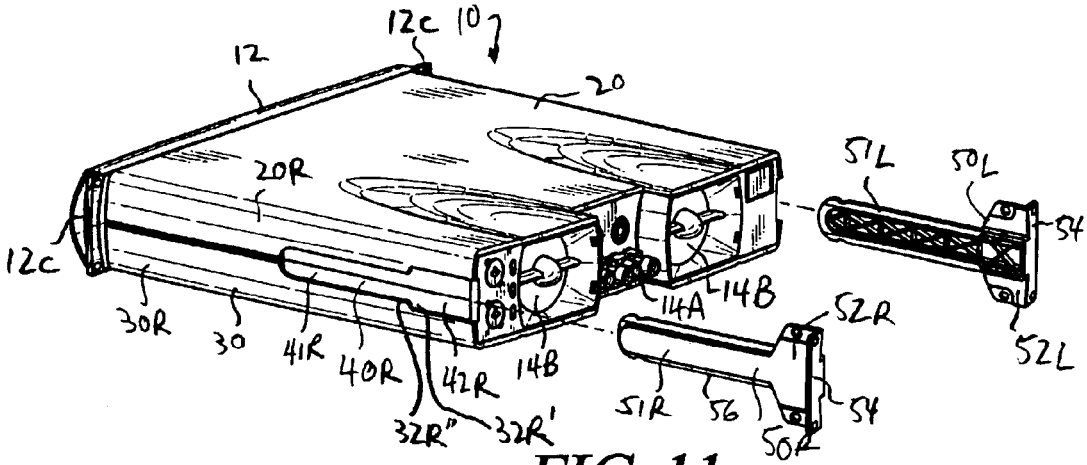
FIG. 11 is a rear perspective view of the housing construction of FIG. 1, with rack ears shown about to be inserted in the track grooves thereof.

As illustrated in FIGS. 10 and 11, right and left track grooves 40R and 40L each have a forward-most (with respect to front and rear of housing 10) reduced-width segment, 41L and 41R, and a rear-most increased-width segment, 42L and 42R. In other words, forward-most segments 41L and 41R are closer to front panel 12 than are rear-most increased-width segments 41L and 41R. Right and left sliding rack ears 50R and 50L each include a forward-most reduced-width segment 51R and 51L and a rear-most increased-width segment 52R and 52L complementary to the reduced-width segments 41L and 41R and increased-width segments 42L and 42R of right and left track grooves 40L and 40R. In addition, rack ears 50L and 50R each include an ear portion 54 defined thereon, for mounting of rack ears 50L and 50R to rack 200.

In this manner, as housing 10 is slid onto rack ears 50L and 50R, forward-most reduced-width segments 51L and 51R of rack ears 50L and 50R are engaged by forward-most reduced-width segments 41L and 41R of track grooves 40L and 40R and then rear-most increased-width segments 52L and 52R of rack ears 50L and 50R are engaged by rear-most increased-width segments 42L and 42R of track grooves 40L and 40R in order to thereby mount housing 10 on rack ears 50L and 50R.

Figure 2:
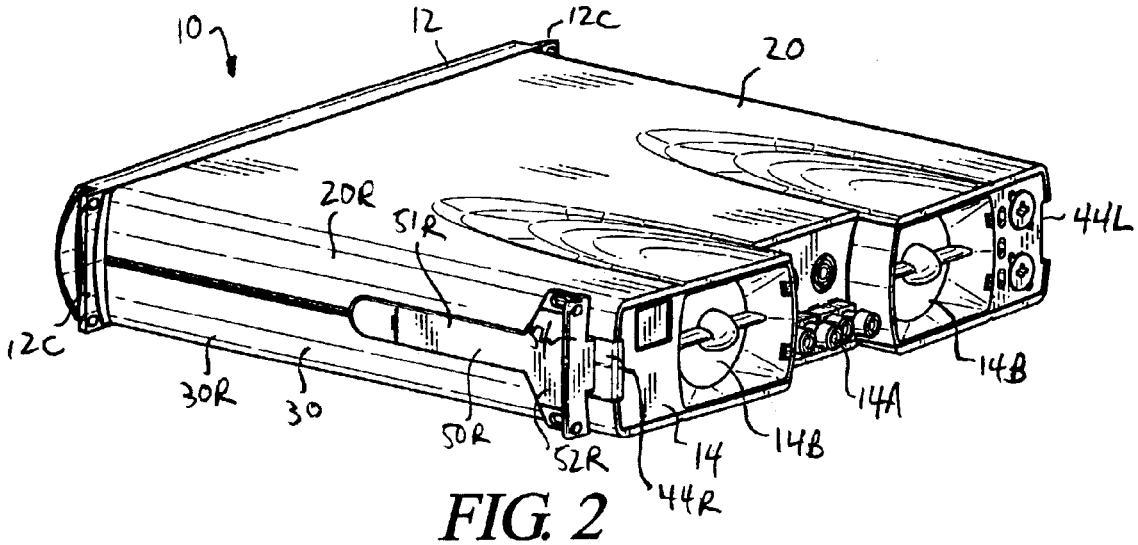
FIG. 2 is a rear perspective view of the housing construction of FIG. 1.
Figure 3:
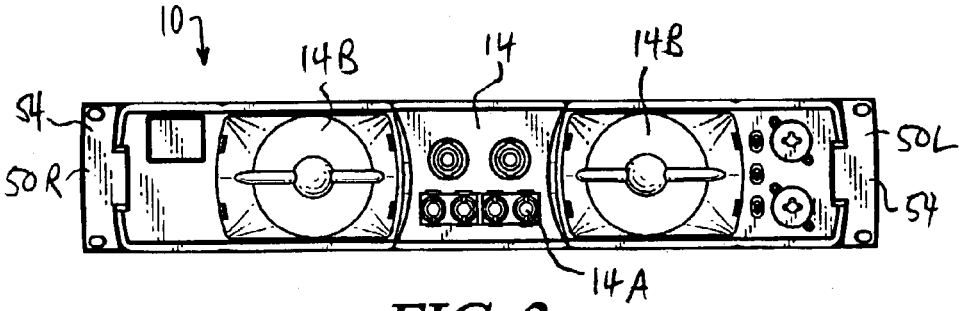
FIG. 3 is a rear plan view of the housing construction of FIG. 1.

As best seen in FIG. 2, right and left track grooves 40R and 40L are open at their rearward ends 44R and 44L, with respect to right and left sides of housing 10, in order to receive rack ears 50R and 50L therein.

In order to securely engage rack ears 50L and 50R, track grooves 40R and 40L are formed with slots formed therein sized to receive the edges of rack ears 50L and 50R. The slots are formed in track grooves 40R and 40L by forming each of right and left upper and lower track groove portions 22R, 22L, 32R, and 32L so as to have inner walls 22R', 22L', 32R' and 32L' and outer walls 22R", 22L", 32R" and 32L" with a space therebetween comprising the slot formed along the periphery of track grooves 40R and 40L when upper and lower housing portions 20 and 30 are mated to form housing 10, as illustrated in FIGS. 6–8.

Similarly, rack ears 50L and 50R can each comprise a lip 56 extending about the perimeter thereof, wherein lip 56 is received in the slots formed in track grooves 40R and 40L such that lip 56 is retained in place within track grooves 40R and 40L.

The elongated nature of forward-most reduced-width segments 51L and 51R of rack ears 50L and 50R and their close sliding fit within forward-most reduced-width segments 41L and 41R of track grooves 40L and 40R allows track grooves 40L and 40R to slide forward and rearward on rack ears 50L and 50R while maintaining a substantially rigid structural engagement between track grooves 40R and 40L and rack ears 50R and 50L, thus allowing housing 10 to be mounted in an adjustable fashion within a conventional equipment rack. Rack ears 50L and 50R are mounted to rack 200 through ears 54, such as by the use of screws, bolts or other like mounting devices.

In a preferred embodiment, front panel 12 of housing 10 also comprises panel ears 12C which are then mounted to a front of the rack and thus secure housing 10 within the rack and prevent housing 10 from sliding forward even when rack ears 50L and 50R are not fully engaged by track grooves 40R and 40L.

As noted above, front housing panel 12 also comprises apertures 12B formed therein. Rear housing panel 14 has complimentary apertures 14B also formed therein. Apertures 12B and 14B combine to provide a passageway for air through housing 10 in order to provide thermal dissipation and help keep electronic equipment mounted in housing 10 cool. By use of rack ears 50L and 50R and track grooves 40R and 40L to mount housing 10 in a suitable rack 200, air flow through housing 10 is maximized by avoiding air flow blockages caused by butting housing 10 directly against a solid surface which would otherwise block air flow.

Figure 5:
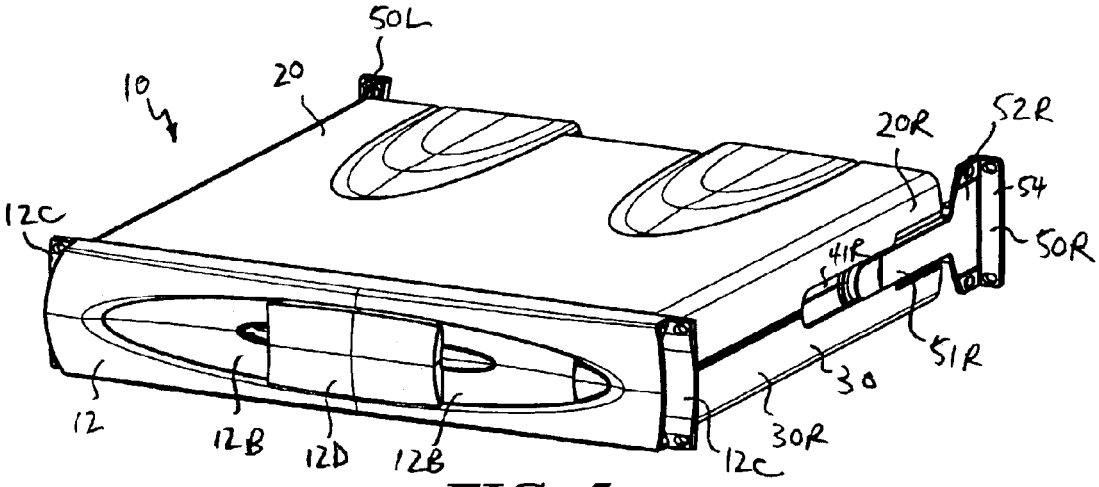
FIG. 5 is a front perspective view of the housing construction of FIG. 1, with rack ears partially inserted in the track grooves thereof.
Figure 12:
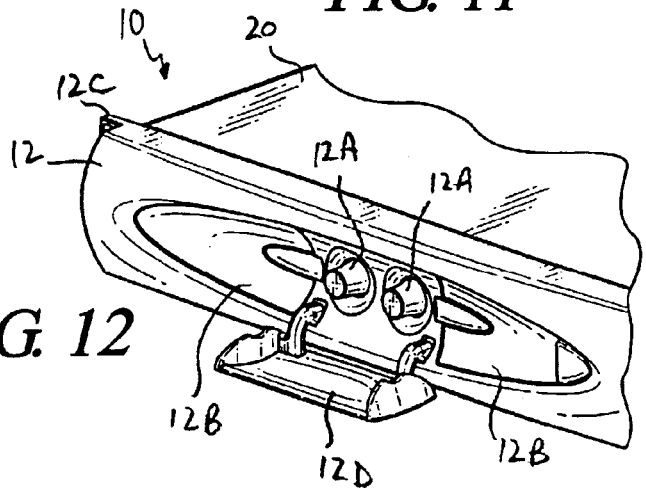
FIG. 12 is a partial front perspective view of the housing construction of FIG. 1, having the front panel door in the open position.

In addition, front panel 12 can also comprise and access door 12D, shown in a closed position in FIGS. 1 and 5 and in an open position in FIG. 12 which can conceal control knobs 12A for the electronic apparatus.

As noted above, housing 10 can be formed of die cast aluminum as opposed to prior art housings formed of bent sheet metal. One of the advantages in the use of die cast aluminum is in superior thermal transfer capability for dissipating heat generated within the housing. In additions, die casting provides the formation in housing 10 of complex features, such as apertures 12B and 14B and track grooves 40R and 40L.

All cited patents and publications referred to in this application are incorporated by reference.

The invention thus being described, it will be apparent that it may be varied in many ways. Such variations are not to be regarded as a departure from the spirit and scope of the present invention and all such modifications as would be apparent as one skilled in the art are intended to be included within the scope of the following claims.

What is claimed is:

1. A housing for an electronic apparatus capable of being mounted in a rack by a rack ear, comprising:

a. an upper housing portion comprising a top and left and right sides, each of the left and right sides having a front and a rear, wherein each of the sides of the upper housing portion comprises an upper groove portion defined therein, the upper groove portion formed by a indentation formed in each of the sides;

b. a lower housing portion comprising a bottom and left and right sides, each of the sides having a front and a rear, wherein each of the sides of the lower housing portion comprises a lower groove portion defined therein, the lower groove portion formed by a indentation formed in each of the sides, wherein the upper housing portion and the lower housing portion cooperate to form the housing, and further wherein, when the upper housing portion and the lower housing portion are combined to form the housing, the upper groove portion and the lower groove portion combine to form a track groove shaped to receive a rack mounting ear on the left and right sides of the housing.

2. The housing of claim 1 wherein the upper groove portion comprises a wider portion disposed near the rear of the sides of the upper housing portion and extending closer to the top of the upper housing portion and a narrower portion disposed closer to the front of the sides of the upper housing portion than the wider portion and not extending as close to the top of the upper housing portion as the wider portion.

3. The housing of claim 2 wherein the lower groove portion comprises a wider portion disposed near the rear of the sides of the lower housing portion and extending closer to the bottom of the lower housing portion and a narrower portion disposed closer to the front of the sides of the lower housing portion than the wider portion and not extending as close to the bottom of the lower housing portion as the wider portion.

4. The housing of claim 3 wherein the track groove formed from the combination of the upper groove portion and the lower groove portion has a front-most narrow portion and a rear-most wide portion.

5. The housing of claim 4 which further comprises a rack ear having a front-most narrow portion and a rear-most wide portion and shaped so as to be capable of being received in each of the track grooves.

6. The housing of claim 1 wherein at least one of the upper track groove portions and lower track groove portions comprise a slot formed by forming a lip about at least a portion of the periphery of the at least one of the upper track groove portions and lower track groove portions.

7. The housing of claim 6 wherein the lip formed about at least a portion of the periphery of the at least one of the upper track groove portions and lower track groove portions is integral with the unindented body of the side of the housing on which it is located.

8. The housing of claim 6 which further comprises a rack ear having a front-most narrow portion and a rear-most wide portion and shaped so as to be capable of being received in each of the track grooves.

9. The housing of claim 8 wherein the rack ear comprises a lip portion formed in at least a portion of its periphery, the lip portion sized to be received in the slot formed in at least one of the track grooves.

10. The housing of claim 1 which further comprises a rack ear shaped so as to be capable of being received in each of the track grooves.

11. The housing of claim 10 wherein the rack ear comprises an ear portion capable of being mounted to a rack for electronic apparatus.

12. The housing of claim 1 which further comprises a front panel having extensions therefrom which have mounting holes for mounting to a front portion of a rack for electronic apparatus.

13. The housing of claim 1 wherein the housing comprises a housing for an audio amplifier.

14. The housing of claim 1 wherein the upper and lower housing portions are each formed of die cast aluminum.

15. A housing construction for a rack mounted electronic apparatus, comprising:

an upper housing portion, having at least two upper track groove portions defined therein;

a lower housing portion, having at least two lower track groove portions defined therein, the upper and lower housing portions being fitted together to form a housing such that the upper and lower track groove portions together define first and second track grooves on opposite sides of the housing; and first and second sliding rack ears received in the first and second track grooves, for mounting the apparatus in a rack.

16. The housing construction of claim 15 wherein the upper and lower housing portions are each constructed of die cast aluminum.

17. The housing construction of claim 16, further comprising:

a die cast aluminum front housing panel attached to the upper and lower housing portions;

a die cast aluminum rear housing panel attached to the upper and lower housing portions;

the rear housing panel having at least one air aperture defined therein; and the front housing panel having at least one air aperture defined therein.

18. The housing construction of claim 15 wherein the rack ears comprise an ear portion capable of being mounted to a rack for electronic apparatus.

19. The housing construction of claim 18 wherein the rack ears have a front-most narrow portion and a rear-most wide portion and are shaped so as to be capable of being received in each of the track grooves.

20. The housing construction of claim 15 wherein the housing comprises a housing for an audio amplifier.

21. A housing for an electronic apparatus capable of being mounted in a rack by a rack ear, comprising:

a. an upper housing portion comprising a top and left and right sides, each of the left and right sides having a front and a rear, wherein each of the sides of the upper housing portion comprises an upper groove portion defined therein, the upper groove portion formed by a indentation formed in each of the sides;

b. a lower housing portion comprising a bottom and left and right sides, each of the sides having a front and a rear, wherein each of the sides of the lower housing portion comprises a lower groove portion defined therein, the lower groove portion formed by a indentation formed in each of the sides, wherein the upper housing portion and the lower housing portion cooperate to form the housing, and further wherein, when the upper housing portion and the lower housing portion are combined to form the housing, the upper groove portion and the lower groove portion combine to form a track groove shaped to receive a rack mounting ear on the left and right sides of the housing, wherein at least one of the upper track groove portions and lower track groove portions comprise a slot formed by forming a lip about at least a portion of the periphery of the at least one of the upper track groove portions and lower track groove portions, c. a rack ear having a front-most narrow portion and a rear-portion wide portion and shape so as to be capable of being receive in each of the track grooves, the rack ear comprising a lip portion formed in at least a portion of it periphery, the lip portion size to be receive in the slot formed in at least one of the track grooves.

22. A housing for an electronic apparatus capable of being mounted in a rack by a rack ear, comprising:

a. an upper housing portion comprising a top and left and right sides, each of the left and right sides having a front and a rear, wherein each of the sides of the upper housing portion comprises an upper groove portion defined therein, the upper groove portion formed by a indentation formed in each of the sides;

b. a lower housing portion comprising a bottom and left and right sides, each of the sides having a front and a rear, wherein each of the sides of the lower housing portion comprises a lower groove portion defined therein, the lower groove portion formed by a indentation formed in each of the sides, wherein the upper housing portion and the lower housing portion cooperate to form the housing, and further wherein, when the upper housing portion and the lower housing portion are combined to form the housing, the upper groove portion and the lower groove portion combine to form a track groove shaped to receive a rack mounting ear on the left and right sides of the housing, and c. a front panel having extensions therefrom which have mounting holes for mounting to a front portion of a rack for electronic apparatus.

* * * * *